US009018600B2

(12) United States Patent
Stowell et al.

(10) Patent No.: US 9,018,600 B2
(45) Date of Patent: Apr. 28, 2015

(54) UV LED CURING ASSEMBLY

(75) Inventors: Quinton Stowell, Cambridgeshire (GB); David Armitage, Berkshire (GB)

(73) Assignee: Baldwin UV Limited, Berkshire (GB)

( * ) Notice: Subject to any disclaimer, the term of this patent is extended or adjusted under 35 U.S.C. 154(b) by 352 days.

(21) Appl. No.: 13/116,067

(22) Filed: May 26, 2011

(65) Prior Publication Data

US 2011/0290179 A1 Dec. 1, 2011

(30) Foreign Application Priority Data

May 28, 2010 (GB) ..... 1009063.7

(51) Int. Cl.

| | |
|---|---|
| ***F26B 3/28*** | (2006.01) |
| ***B41J 11/00*** | (2006.01) |
| ***F21K 99/00*** | (2010.01) |
| ***F41G 11/00*** | (2006.01) |

(52) U.S. Cl.

CPC ..... *B41J 11/002* (2013.01); *F26B 3/283* (2013.01); *F21K 9/00* (2013.01); *F41G 11/003* (2013.01)

(58) Field of Classification Search

CPC ..... G01N 17/004; G02F 1/133603; G02F 1/133609; F26B 3/283; F21K 9/00

USPC ..... 250/492.1

See application file for complete search history.

(56) References Cited

U.S. PATENT DOCUMENTS

| | | | | |
|---|---|---|---|---|
| 3,573,456 | A * | 4/1971 | Beeh | 250/475.2 |
| 5,091,915 | A * | 2/1992 | Tatsumi et al. | 372/75 |
| 5,826,643 | A * | 10/1998 | Galyon et al. | 165/80.4 |
| 5,973,331 | A * | 10/1999 | Stevens et al. | 250/492.1 |
| 6,276,822 | B1 * | 8/2001 | Bedrosian et al. | 362/545 |
| 6,469,322 | B1 * | 10/2002 | Srivastava et al. | 257/89 |
| D470,255 | S * | 2/2003 | Lodhie | D26/3 |
| 6,683,421 | B1 | 1/2004 | Kennedy et al. | |
| D553,266 | S * | 10/2007 | Maxik | D26/2 |
| 2004/0008475 | A1 * | 1/2004 | Ohashi et al. | 361/681 |
| 2004/0075065 | A1 * | 4/2004 | Spivak | 250/504 R |
| 2004/0090794 | A1 | 5/2004 | Ollett et al. | |
| 2004/0114367 | A1 * | 6/2004 | Li | 362/248 |
| 2004/0135159 | A1 * | 7/2004 | Siegel | 257/88 |
| 2005/0042390 | A1 * | 2/2005 | Siegel | 427/585 |
| 2005/0062830 | A1 | 3/2005 | Taki et al. | |
| 2005/0087768 | A1 * | 4/2005 | March et al. | 257/200 |
| 2005/0174769 | A1 * | 8/2005 | Yong et al. | 362/235 |
| 2005/0196720 | A1 * | 9/2005 | Ostler et al. | 433/29 |
| 2005/0212404 | A1 * | 9/2005 | Chen et al. | 313/500 |
| 2005/0222295 | A1 * | 10/2005 | Siegel | 522/8 |
| 2005/0280683 | A1 * | 12/2005 | Custer | 347/102 |
| 2006/0291245 | A1 * | 12/2006 | Shimada | 362/612 |
| 2007/0024191 | A1 * | 2/2007 | Chen et al. | 313/512 |
| 2007/0159849 | A1 * | 7/2007 | Sakai | 362/612 |
| 2008/0280227 | A1 * | 11/2008 | Sievers | 430/270.1 |

(Continued)

FOREIGN PATENT DOCUMENTS

| | | |
|---|---|---|
| EP | 1520718 A1 | 4/2005 |
| GB | 2360084 | 9/2001 |

(Continued)

*Primary Examiner* — Phillip A Johnston

*Assistant Examiner* — Sean Luck

(74) *Attorney, Agent, or Firm* — Thompson Coburn LLP

(57) ABSTRACT

A curing assembly for curing of inks and the like comprises at least one array of UV LEDs 18. A reflector 4 with an elongate reflective surface 14 partly surrounds the array 18 and has an opening for emission of radiation towards a substrate. A lens 24 is positioned between the array 18 and the opening.

20 Claims, 7 Drawing Sheets

(56) References Cited

U.S. PATENT DOCUMENTS

| | | | | |
|---|---|---|---|---|
| 2008/0315132 | A1* | 12/2008 | Platsch | 250/504 R |
| 2009/0002669 | A1* | 1/2009 | Liu et al. | 355/67 |
| 2009/0034236 | A1* | 2/2009 | Reuben | 362/103 |
| 2009/0052190 | A1* | 2/2009 | Shimada | 362/296.05 |
| 2009/0201368 | A1* | 8/2009 | Evans | 348/127 |

FOREIGN PATENT DOCUMENTS

| | | |
|---|---|---|
| GB | 2407371 | 4/2005 |
| WO | 96/28302 | 9/1996 |
| WO | 2007/096824 A2 | 8/2007 |

* cited by examiner

UV LED CURING ASSEMBLY

This invention relates to curing assemblies such as are used in the printing and coating industry for the fast curing of inks and the like on a large variety of substrate materials. During the curing process, the substrate is moved in a path beneath an elongate radiation source so that a coating on the substrate is irradiated by radiation from the source to cure the coating in a continuous process. The substrate may be continuous or comprise multiple sheets which are fed past the source in succession.

It is well known to cure inks on the substrate by application of ultra-violet radiation from one or more medium-pressure mercury vapour ultra-violet lamps. It is also well known to provide each lamp in an assembly with a reflector which includes a reflective surface partly surrounding the lamp for reflecting radiation therefrom onto the substrate. The reflective surface has a concave profile which is commonly elliptical or parabolic, the lamp being mounted on the symmetrical centre line of the profile and adjacent the apex.

The reflector increases the intensity of the radiation received by the curable coating. The penetration of the radiation into the coating is an important factor in curing and, whilst penetration varies with different colours and materials, the higher the intensity, the better the penetration.

One drawback of mercury lamps is that they generate large amounts of heat and IR radiation which can damage the substrate being cured, for example by warping and/or distortion. A further disadvantage is the slow start up of mercury lamps which can take one to two minutes to reach the operating temperature. As a consequence of recent years there has been great interest in using UV LEDs as the UV radiation source for curing applications since the performance of UV LEDs has increased to the point where they are a viable alternative to mercury lamps.

However, UV LEDs themselves have problems, one of which is the ability to focus sufficient radiation onto the substrate being cured. There are many printing machines in use where the distance between the radiation source and substrate is in the range of 30 to 50 mm and some where the distance is 100 mm. Thus it is necessary that the radiation be provided effectively across a gap of at least 50 mm.

It is known to use a reflector with UV LEDs of a similar form to those employed with mercury lamps. However, this does not provide sufficient radiation intensity at large gaps such as 50 mm. Light intensity at a distance is also a problem with known systems where either the LEDs are provided with individual lenses or the LEDs are arranged in a row and a lens provided for each row.

The present invention provides a curing assembly comprising at least one array of UV LEDs, a reflector with an elongate reflective surface partly surrounding the array and having an opening for emission of radiation towards a substrate supported in a position to receive radiation emitted through the opening for curing a coating thereon, and a lens between the array and the opening.

It has been found that the combination of a reflector and a lens enables efficient generation of an intense beam of radiation even at high source-substrate distances. The combination makes for a very compact an efficient optical system.

In one preferred embodiment the reflective surface has two focal points and the array is located at one focal point and the substrate support position at the other. This produces good focussing of radiation from the array onto the substrate support position. However, direct rays which are continually diverging do not come to the reflective surface focal point.

The lens is provided for these direct rays and preferably it and the reflective surface have a common focal point at the substrate support position.

The reflective surface is shaped and positioned to maximise reflection of radiation which does not pass through the lens and to minimise the amount of radiation which is reflected back onto the lens. The reflective surface can be designed to meet these criteria in the form of an ellipse or an arc.

The lens may be a cylindrical rod. Alternatively the lens may be a rod of semicircular cross-section which may be arranged with the curved face adjacent the array. In either case the rod is preferably formed of quartz due to its high refractive index and good transmission of UV light. With both alternatives the lens is simple in form and cheap to provide.

Alternatively the lens may be a convergent lens arranged to focus radiation at the substrate support position. The lens will be ground or otherwise shaped to function as in a pair of spectacles. Whilst this is a more expensive option, it can produce great efficiency of curing.

The LEDs may be arranged in a pattern with LEDs in outer regions being closer together than the other LEDs. There may be a central region where the LEDs are rotated relative the other LEDs, preferably by 45 degrees, and/or the LEDs in the central region may be spaced further apart than the other LEDs.

In one embodiment the outer regions may comprise two or more rows of LEDs and there may be an intermediate region between each outer region and the central region where the LEDs are arranged in staggered rows.

One problem with the use of UV LEDs is overheating of the LEDs as they are driven at high current. Commonly the LEDs are only 25% efficient with heat accounting for the other 75%. Another is the inevitable UV drop off that occurs at outer regions of the array, which is often referred to as the "end effect".

The preferred pattern overcomes these problems. The closer positioning of the LEDs or dies in the outer regions offsets the "end effect". Making the spacing of the other LEDs higher leads to better thermal heat transfer and a reduced heat effect from one die on adjacent dies. The rotation and spacing of the centrally positioned LEDs allows for circuit tracks to be laid and provides for maximum heat transfer efficiency in the centre.

The array pattern has a packing density which is between 15 to 50%, preferably between 20 to 38%, the packing density being defined as:

$$\text{Packing density} = \frac{\text{Area of dies}}{\text{Pitch area between dies}} \times 100\%$$

The "pitch" is the distance between the centres of adjacent LEDs. The "pitch area" is calculated by multiplying the pitch in the longitudinal direction of the board by the pitch in the width wise direction. The "area of dies" is calculated by multiplying the die width and die length which with square dies will be the same.

The LEDs are mounted on a circuit board which may be water cooled. Water cooling can be achieved by use of one or more blocks of material with good heat transfer properties, such as copper, in conjunction with a manifold though which water is continuously circulated.

The invention will now be further described by way of example with reference to the accompanying drawings in which.

Figure 2:
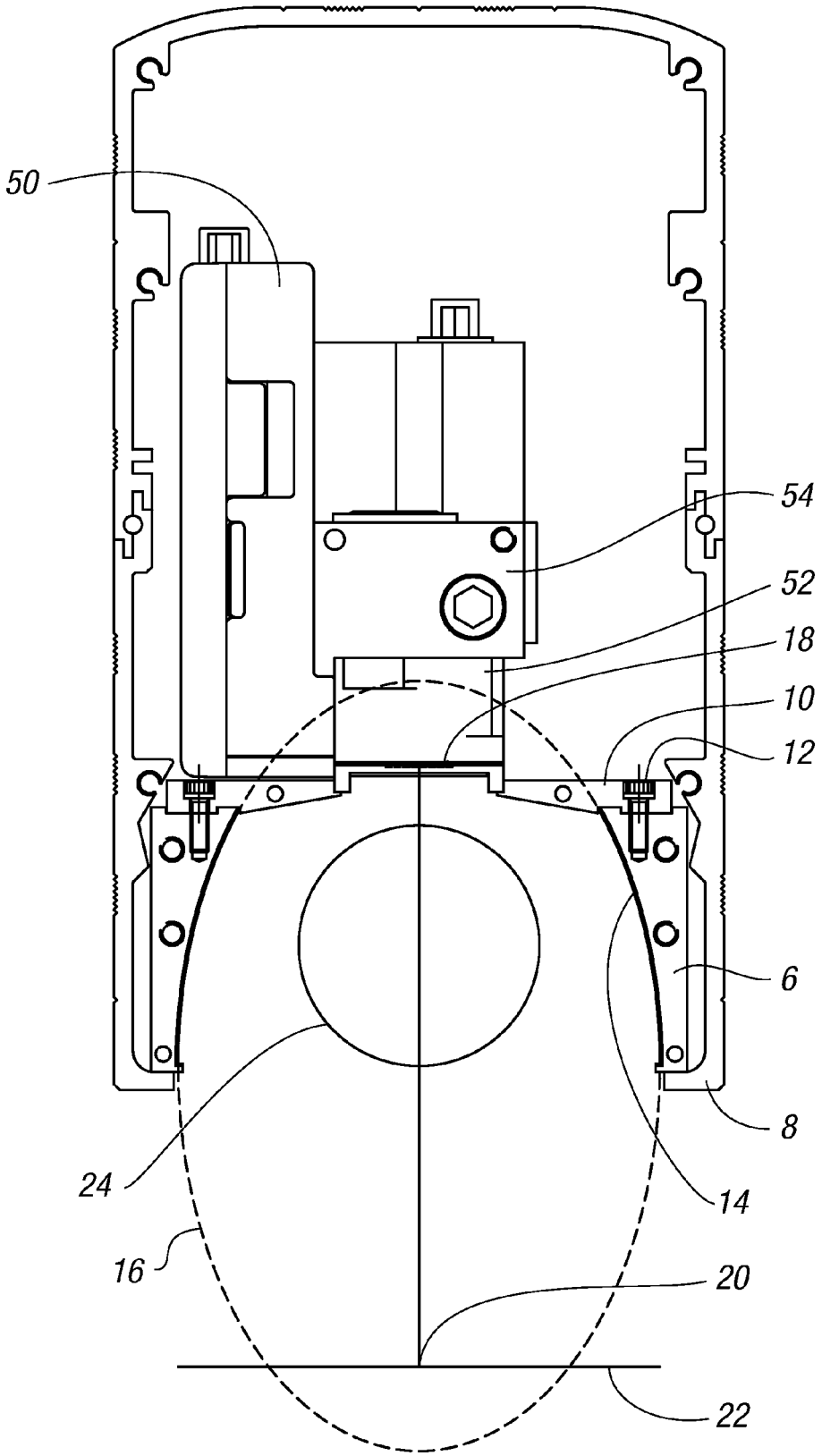
FIG. 2 is an end view of the curing assembly of FIG. 1.

The curing assembly 2 comprises a reflector 4 preferably made of extruded aluminium and formed of two reflector elements 6 each secured in place between a flange 8 and a support 10 by bolts 12. The reflector 4 provides a reflective surface 14 which in the form illustrated in FIG. 2 is elliptical. The full ellipse is show in dotted outline at 16. The ellipse 16 has two focal points, an upper focal point at which an LED array 18 is positioned and a lower focal point 20.

The assembly 2 includes a substrate support which positions a substrate at the location indicated by line 22 which extends through the lower focal point 20. Alternatively the substrate support could be separate from the assembly and could be, for example, the curved impression cylinder of a printing press.

A lens 24 is supported by end plates 26 between the LED array 18 and the substrate support position 22. The lens 24 is shown in the figures as a cylindrical rod but could take other forms including in particular a rod having a semicircular cross-section arranged with the curved surface facing towards or away from the LED array 18. A further alternative is a lens which is ground or otherwise shaped to make it convergent.

Whatever form the lens 24 takes, it is arranged such that its focal point coincides with the lower focal point 20 of the ellipse 16.

Figure 3:
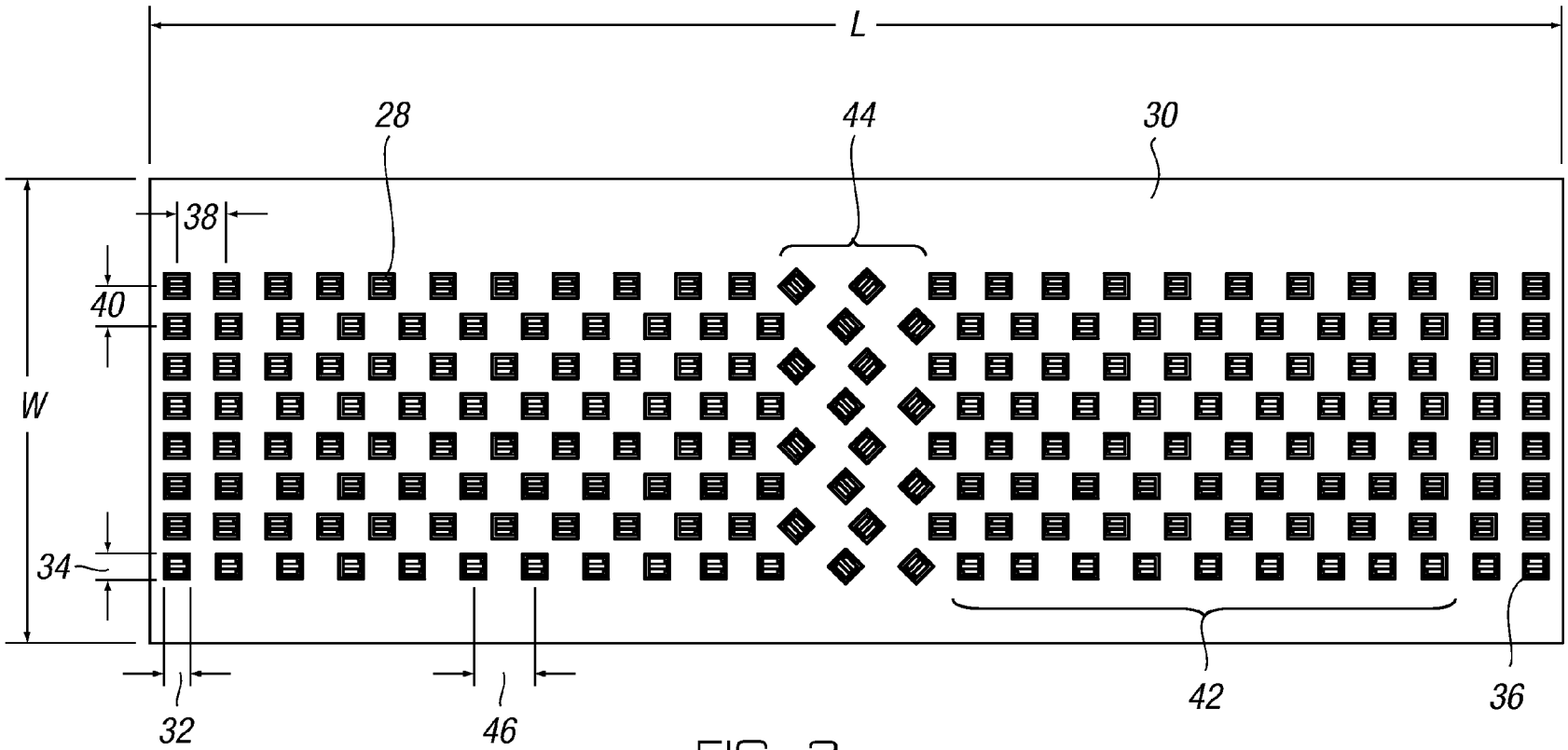
FIG. 3 is a plan view of an LED array suitable for use in the assembly of FIG. 1.

One preferred form for the LED array 18 is illustrated in FIG. 3. This has square LEDs 28 mounted on a circuit board 30. In the embodiment of FIG. 3 the LEDs 28 have a width 32 and a depth 34 of 1.07 mm. In the two rows 36 at each end of the board 30 the longitudinal pitch 38 is 2.10 mm whilst the lateral pitch 40 is 1.70 mm. There are then two regions 42 one on either side and separated by a central region 44. The LEDs 28 in the regions 42 are arranged in staggered rows. The transverse pitch 40 remains 1.7 mm but the longitudinal pitch 46 is increased to 2.6 mm. The LEDs 28 in the central region 44 are reoriented by 45° with respect to the other LEDs 28 and the space in between them is slightly wider to allow for circuit tracks to be laid.

The packing density of the LEDS 28 in the outer rows 36 is 31% whilst the packing density in the regions 42 is 26%.

The close packing of the LEDs 28 in the rows 36 compensates for the drop off which is found to occur in radiation intensity at the edge regions of LED arrays. The increased spacing of the LEDs 28 in the intermediate and central regions 42, 44 improves heat transfer and reduces the effect of heat from one die on adjacent dies. The rotation and spacing of the LEDs 28 in the central region 44 also improves heat transfer in this region and, as noted, allows for circuit tracks to be laid.

Figure 4:
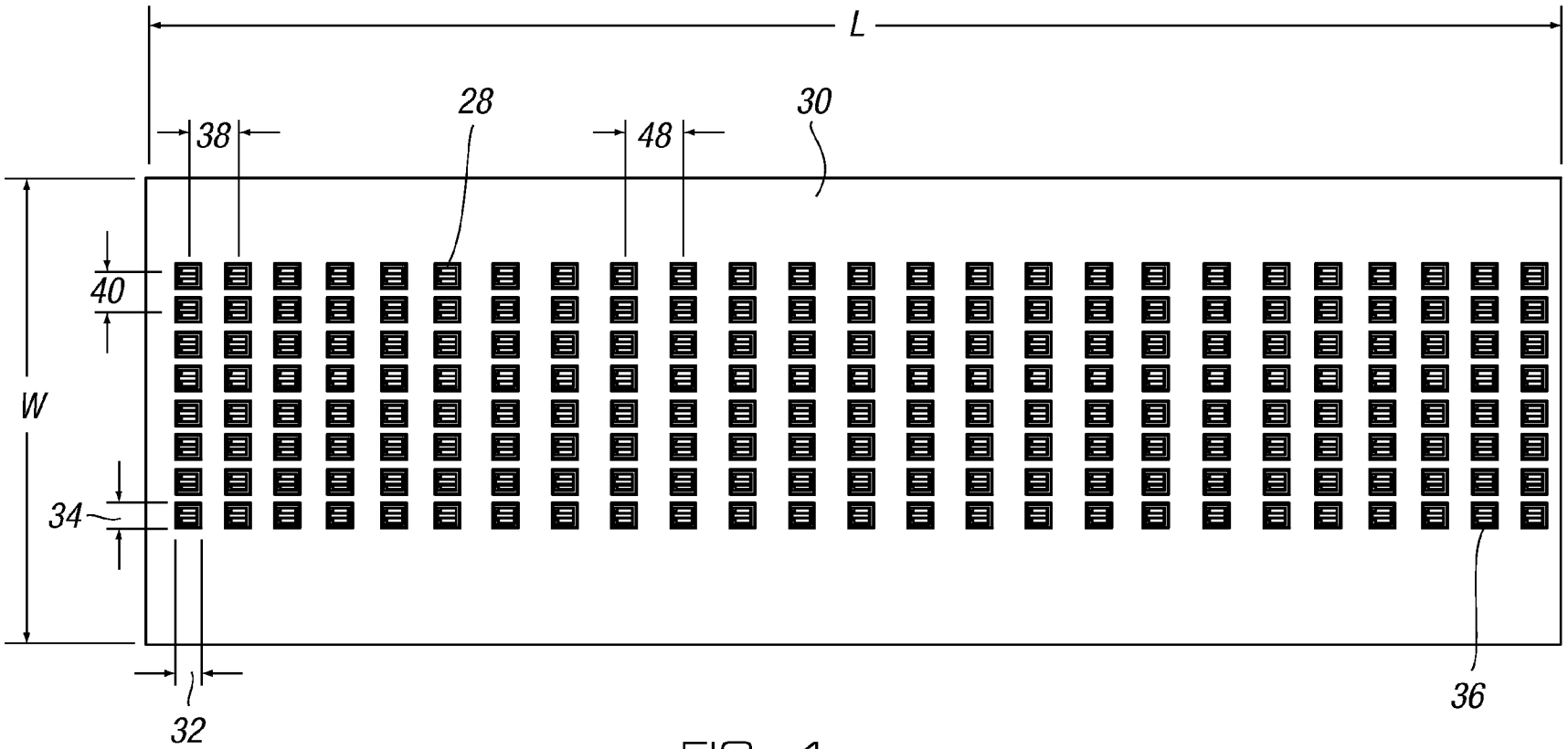
FIG. 4 is a plan view of another LED array suitable for use in the assembly of FIG. 1, and FIGS. 5 to 7 are ray diagrams illustrating the operation of the assembly of FIG. 1.

FIG. 4 illustrates another preferred form for the LED array 18. As with that of FIG. 3, the LEDs 28 are square and 1.07×1.07 mm. The longitudinal pitch 38 is 2.10 mm in the three outer row 36 whilst the lateral pitch 40 in those rows 36 is 1.45 mm. The LEDs 28 between the outer rows 36 are gradually spread out to a longitudinal pitch 48 of 2.6 mm. The packing density in the outer rows 36 is 38% whilst the packing density therebetween is 32%. The embodiment of FIG. 4 which is more closely packed than that of FIG. 3 is possible with a more thermally conductive circuit board.

In the embodiment of FIG. 3 there are 192 LEDs 28 on a board 30 with a length L of 60.00 mm and a width W of 19.70 mm whilst in the embodiment of FIG. 4 there are 200 LEDs 28 on a board 30 with a length L of 60.00 mm and a width W of 19.70 mm.

Figure 1:
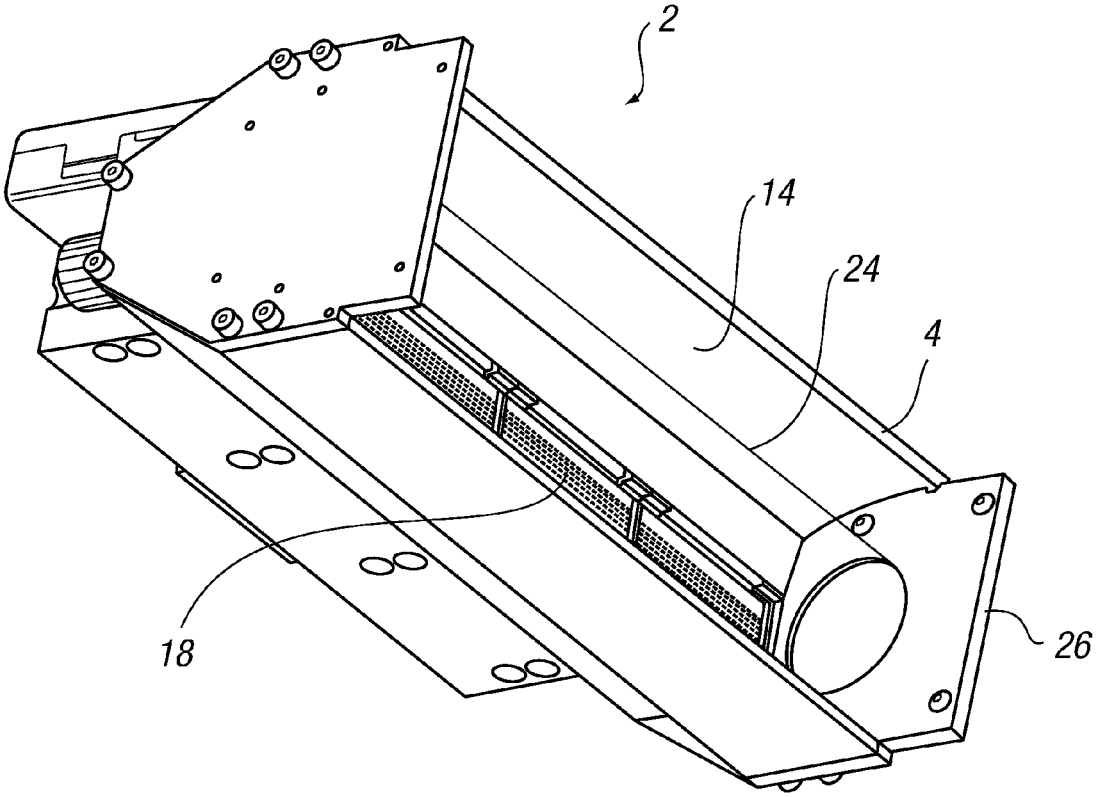
FIG. 1 is a perspective view of a curing assembly in accordance with the invention.

As shown in FIG. 1, there may be multiple arrays 18, four in the illustrated embodiment, one of which is hidden from view. The array or arrays 18 are powered and controlled via a control driver 50. The LEDs 18 generate significant heat and cooling is therefore required. In the illustrated embodiment this is provided by a water cooled copper block 52 which is in thermal contact with a manifold 54 provided with passages for circulation of cooling water.

Figure 5:
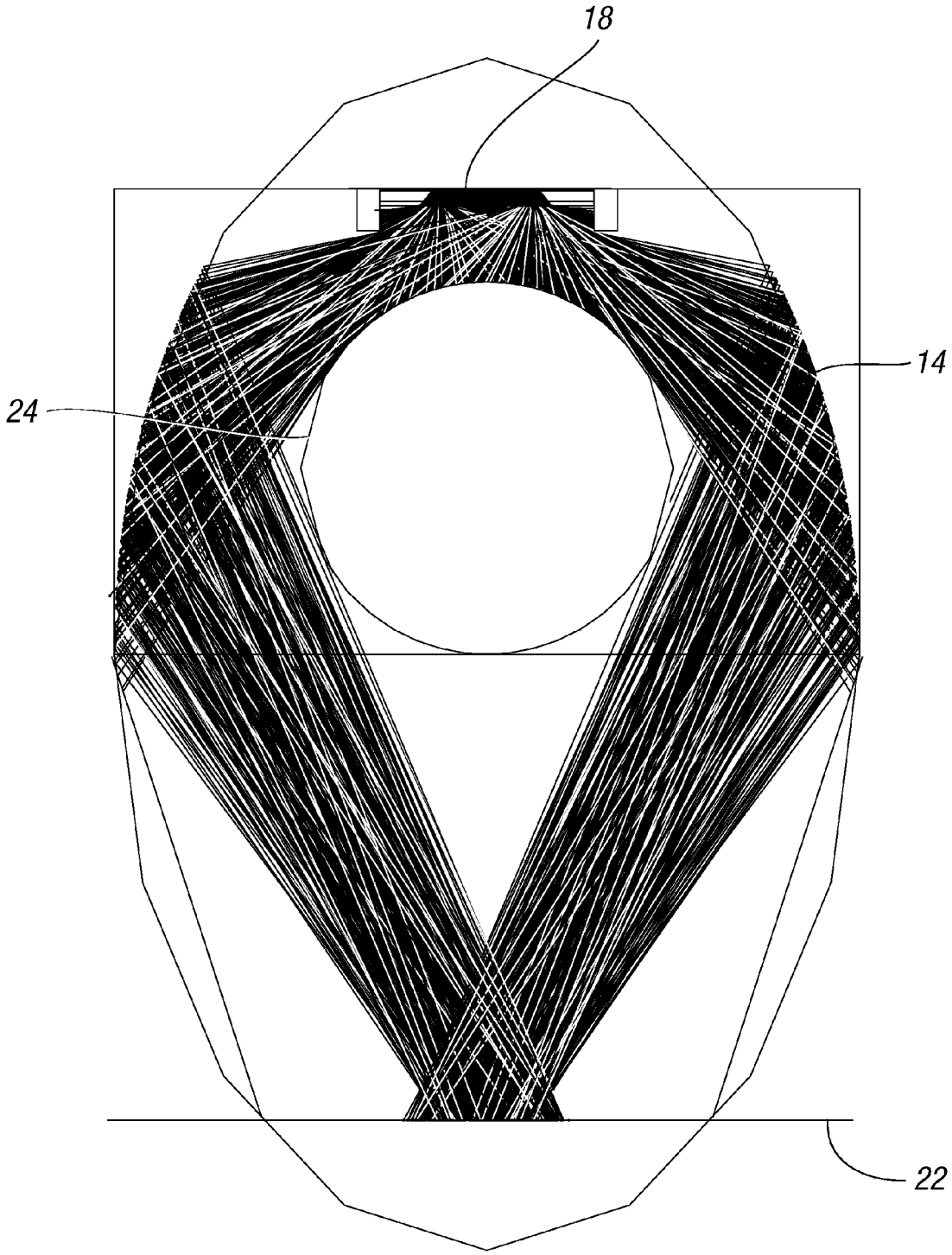
Figure 6:
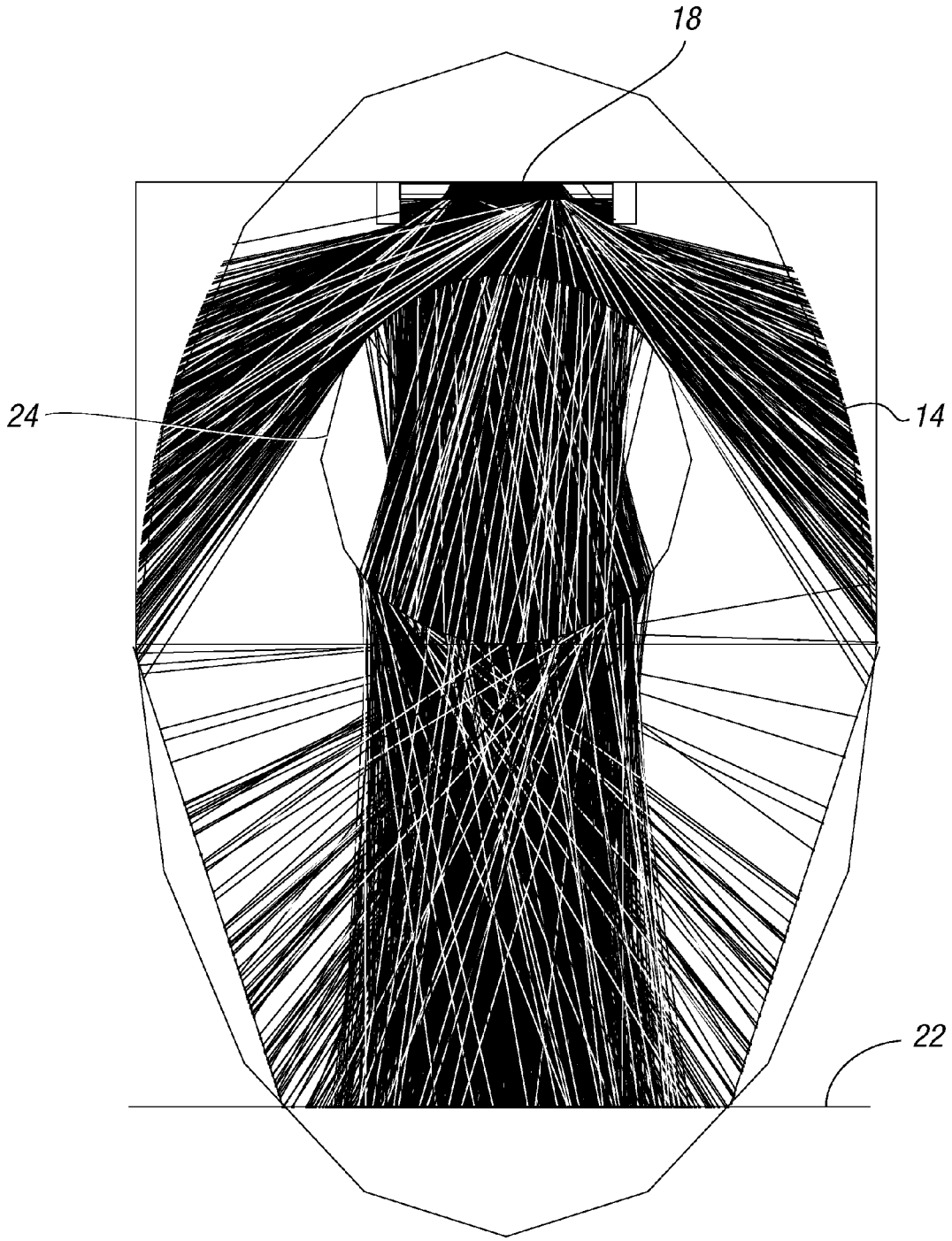
Figure 7:
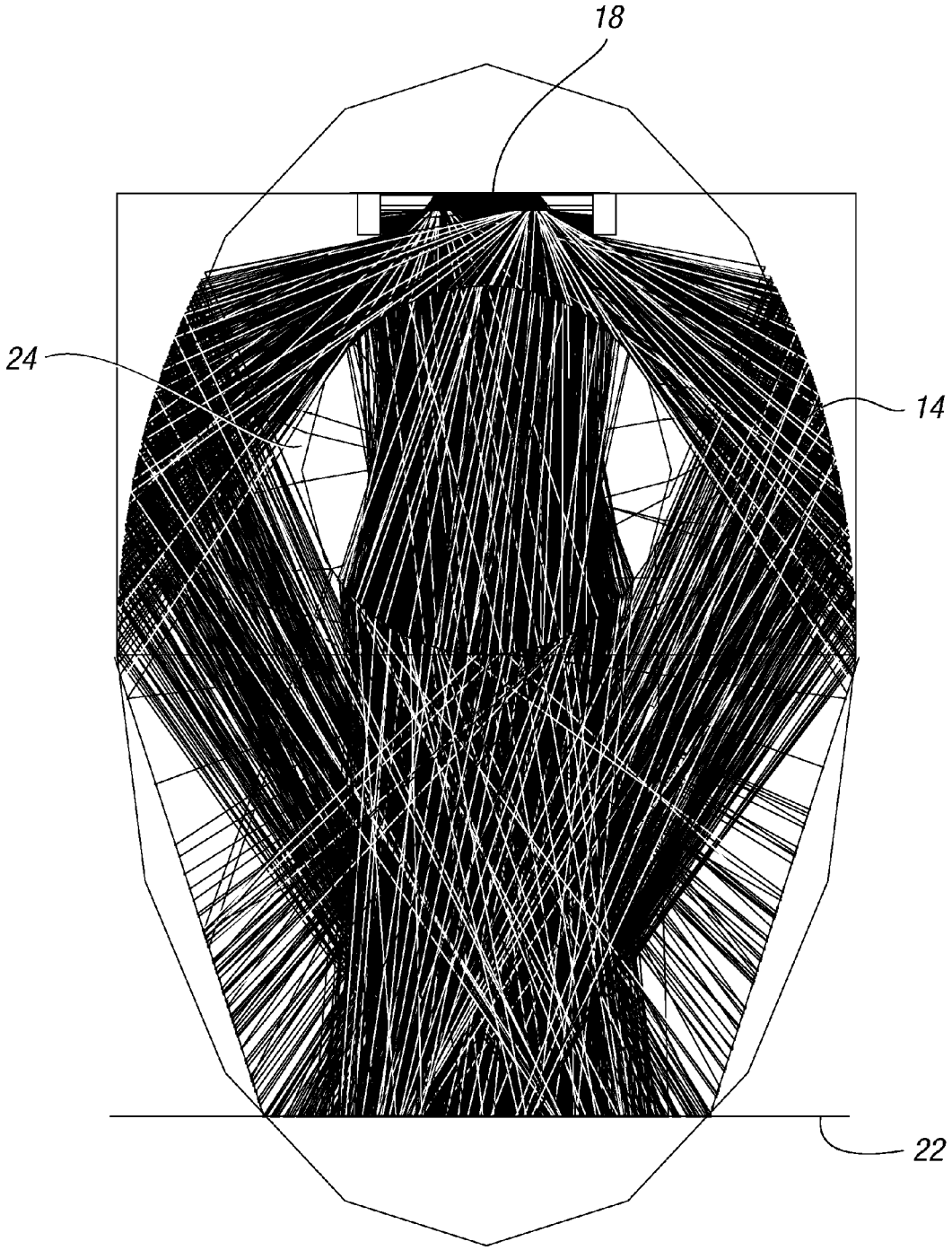

The operation of the combination of the reflective surface 14 and lens 24 is illustrated by FIGS. 5 to 7. These figures, like FIG. 2, show the overall profile of the reflective surface 14. The reflective surface 14 is shown in FIGS. 5 to 7 as a series of flat regions angled towards each other but this is for illustrative purposes only.

FIG. 5 illustrates the path of the UV light from the reflective surface 14 alone whilst FIG. 6 illustrates the path of the UV light through the lens 24 alone i.e. without any reflection from the reflective surface 14. As FIG. 5 illustrates, the reflective surface 14 is arranged such that the rays combine at the substrate support position 22. FIG. 6 shows that the effect of the lens is to generate a column of high intensity radiation.

FIG. 7 illustrates the path of the UV radiation with the combination of the reflective surface 14 and lens 24 of the assembly 2. The result of that combination is high intensity and efficiency even when the substrate support position 22 is at a significant distance from the LED array 18.

The reflective surface 14 is arranged to maximise reflection of the rays and to minimise the quantity of reflective radiation which passes between the lens 24 and the array 18.

It has been found that an elliptical reflective surface 14, as illustrated in FIG. 2, gives optimum results but that it is possible to achieve a high proportion of desired reflection, up to 95%, with an arcuate surface.

As discussed above the lens 24 is in the form of a cylindrical rod. This produces very satisfactory results but even better focussing is possible with a shaped lens 24 although this is at a cost.

The assembly 2 allows use of UV LEDs where the radiation needs to be transmitted over significant distances such as 30 to 50 mm. This is achieved with an assembly which is compact. The design enables even and high UV intensity output.

The invention claimed is:

1. A curing assembly comprising an array of UV LEDs, a lens, and a reflector, the reflector being formed as an elongate reflective surface partly surrounding the array and defining an opening at a distal end of the reflector opposite of the array for emission of radiation towards a substrate supported in a position to receive radiation emitted through the opening for curing a coating thereon, the lens being positioned between the array and the opening defined by the distal end of the reflector, the lens and reflector being configured such that a first portion of an emission of radiation from the LEDs is reflected by the reflector and passes through the opening without passing through the lens and a second portion of the emission of radiation from the LEDs passes through the lens and through the opening without being reflected by the reflector, and a third portion of the emission of radiation from the LEDs is at least one of scattered and reflected by the reflector and passed through the lens and is consistent with a leakage amount; wherein the first portion of the emission of radiation from the LEDs is greater than the third portion of the emission of radiation from the LEDs; wherein the second portion of the emission of radiation from the LEDs is greater than the third portion of the emission of radiation from the LEDs; and wherein the reflective surface and lens have a common focal point at the substrate support position and the first and second portions of the emission of radiation from the LEDs are combined together at a focal region at the substrate support position.

2. A curing assembly as claimed in claim 1 wherein the reflective surface is shaped and positioned to maximize reflection of radiation which does not pass through the lens and to minimize the amount of radiation which is reflected back onto the lens.

3. A curing assembly as claimed in claim 1 wherein the lens is a cylindrical rod.

4. A curing assembly as claimed in claim 1 wherein the lens is a rod of semicircular cross-section.

5. A curing assembly as claimed in claim 1 wherein the lens is a rod formed of quartz.

6. A curing assembly as claimed in claim 1 wherein the lens is a convergent lens arranged to focus radiation at the substrate support position.

7. A curing assembly as claimed in claim 1 wherein a portion of the LEDs in an outer region of the array are arranged in a pattern, and the portion of the LEDs in the pattern of the outer regions of the array are closer together than the other LEDs.

8. A curing assembly as claimed in claim 1 wherein the array defines a plane and a group of LEDs in a central region of the array are rotated relative to another group of LEDs of the array within the plane defined by the array.

9. A curing assembly as claimed in claim 8 wherein the LEDs in the central region are rotated 45 degrees relative the other LEDs.

10. A curing assembly as claimed in claim 8 wherein the LEDs in the central region are spaced further apart than the other LEDs.

11. A curing assembly as claimed in claim 1 wherein the LEDs have a packing density of 15% to 50%.

12. A curing assembly as claimed in claim 1 wherein the LEDs are mounted on a water cooled circuit board.

13. A curing assembly as claimed in claim 1 further comprising a substrate support for supporting a substrate in a position to receive radiation emitted through the opening.

14. A curing assembly as claimed in claim 1 wherein the LEDs have a packing density of 20% to 38%.

15. A curing assembly as claimed in claim 1 wherein a group of LEDs of the array arranged at peripheral edges of the array have a spacing therebetween that is less than a spacing between another group of LEDs of the array arranged in central regions of the array.

16. A curing assembly as claimed in claim 15 wherein the LEDs arranged at the peripheral edges of the array and the LEDs arranged in central regions of the array have a packing density of between 15% and 50%.

17. A curing assembly as claimed in claim 15 wherein the LEDs arranged at the peripheral edges of the array and the LEDs arranged in central regions of the array have a packing density of between 20% and 38%.

18. A curing assembly as claimed in claim 1 wherein a portion of the LEDs of the array that are arranged at longitudinally opposite ends of the array, generally extend in a direction between the distal ends of the reflector across the opening and have a spacing therebetween along the length direction that is less than a spacing along the length direction between other LEDs arranged in central regions of the array.

19. A curing assembly as claimed in claim 18 wherein the LEDs arranged at the peripheral edges of the array and the LEDs arranged in central regions of the array have a packing density of between 15% and 50%.

20. A curing assembly as claimed in claim 18 wherein the LEDs arranged at the peripheral edges of the array and the LEDs arranged in central regions of the array have a packing density of between 20% and 38%.

* * * * *